US006390875B1

(12) United States Patent
Warren et al.

(10) Patent No.: US 6,390,875 B1
(45) Date of Patent: May 21, 2002

(54) METHOD FOR ENHANCING THERMAL RADIATION TRANSFER IN X-RAY TUBE COMPONENTS

(75) Inventors: John M. Warren, Waukesha; Michael Price, Brookfield; Martin W. Plutowski, Waukesha, all of WI (US)

(73) Assignee: General Electric Company, Waukesha, WI (US)

( * ) Notice: Subject to any disclaimer, the term of this patent is extended or adjusted under 35 U.S.C. 154(b) by 0 days.

(21) Appl. No.: 09/535,019

(22) Filed: Mar. 24, 2000

(51) Int. Cl.[7] ..... H01J 35/10; H01J 35/16
(52) U.S. Cl. ..... 445/28; 378/127; 378/129
(58) Field of Search ..... 445/28; 378/127, 378/129

(56) References Cited

U.S. PATENT DOCUMENTS 3,345,218 A * 10/1967 Brookover et al. ..... 428/472.1
3,662,211 A * 5/1972 Millis ..... 313/340
4,119,761 A * 10/1978 Kuze et al. ..... 313/355
4,184,100 A * 1/1980 Takanashi et al. ..... 313/337
4,413,355 A * 11/1983 Matsumoto ..... 378/127

* cited by examiner

*Primary Examiner*—Kenneth J. Ramsey
(74) *Attorney, Agent, or Firm*—Jenkens & Gilchrist

(57) ABSTRACT

A method is provided for enhancing heat transfer within an X-ray vacuum tube, from a hot component such as the rotating anode assembly to a cooler component such as the metal tube housing, by increasing surface emissivity of respective components. The method comprises the steps of fabricating each component from an alloy containing a specified minimum amount of chromium, and then implementing a first heating operation, wherein a fabricated component is heated in a dry hydrogen atmosphere for a first specified time period. Thereafter, a second heating operation is implemented, wherein the fabricated component is heated in a wet hydrogen atmosphere for a second specified time period. This procedure forms a refractory chromium oxide coating on the component that exhibits high absorption in the NIR region of the electromagnetic spectrum.

20 Claims, 3 Drawing Sheets

| Test | dew point (°C) | Wavelength Region (microns) | Emissivity Sample 1 | Emissivity Sample 2 | Emissivity Sample 3 |
|---|---|---|---|---|---|
| 1 | 25.2°C | 3-12 | 0.8 | 0.77 | 0.78 |
| | | 8-12 | 0.8 | 0.79 | 0.8 |
| | | 3.9 | 0.78 | 0.93 | 0.93 |
| | | 5.0 | 0.78 | 0.78 | 0.8 |
| | | 10.6 | 0.75 | 0.68 | 0.69 |
| | | ~2.0 | 0.903 | | |
| 2 | 18°C | 3-12 | 0.69 | 0.72 | 0.72 |
| | | 8-12 | 0.65 | 0.72 | 0.7 |
| | | 3.9 | 0.95 | 0.85 | 0.9 |
| | | 5.0 | 0.8 | 0.78 | 0.8 |
| | | 10.6 | 0.5 | 0.57 | 0.58 |
| | | ~2.0 | 0.902 | | |
| 3 | 5.8°C | 3-12 | 0.67 | 0.67 | 0.6 |
| | | 8-12 | 0.63 | 0.6 | 0.52 |
| | | 3.9 | 0.88 | 0.93 | 0.91 |
| | | 5.0 | 0.78 | 0.8 | 0.8 |
| | | 10.6 | 0.45 | 0.46 | 0.4 |
| | | ~2.0 | 0.816 | | |

METHOD FOR ENHANCING THERMAL RADIATION TRANSFER IN X-RAY TUBE COMPONENTS

BACKGROUND OF THE INVENTION

The invention disclosed and claimed herein generally pertains to a method for improving or enhancing thermal radiation transfer between selected X-ray tube components. More particularly, the invention pertains to a method for substantially increasing the ability of X-ray tube components to either emit or absorb thermal radiation in the Near Infrared Radiation (NIR) region, in order to enhance X-ray tube cooling. Even more particularly, the invention pertains to a method for forming a chromium oxide coating on components fabricated from high chromium content alloys specifically to increase the absorption of thermal radiation.

In a rotating anode X-ray tube a beam of electrons is directed through a vacuum and across very high voltage, such as 120 kilovolts, from a cathode to a focal spot position on a tungsten alloy anode target. X-rays are produced as electrons strike the tungsten target track, which is rotated at high speed, and are directed toward an X-ray transmissive window or port plate, provided in the tube housing. However, the conversion efficiency of X-ray tubes is quite low. More specifically, the total fraction of X-ray power emitted from the X-ray tube is typically less than 1% of the total power input. Thus, the remainder, in excess of 99% of the input electron beam power, is converted to thermal energy and contributes solely to heating the rotating anode assembly. Such energy must be dissipated in the forms of both thermal radiation and thermal conduction. Hot anodes in X-ray tubes emit thermal radiation with wavelengths of about 0.4 to about 25 microns, depending on temperature. This range is mainly contained in a region of the electromagnetic spectrum called the Near Infrared Radiation (NIR) region which covers wavelengths from about 0.7 to 25 microns. Failure to effectively remove or otherwise manage this fraction of non-productive energy limits tube performance, both by limiting continuous output power and by reducing the duration of transient, high power cycles. For rotating anode X-ray tubes, the added complexity of accelerated bearing wear is usually associated with a lack of effective cooling.

In a common arrangement, the X-ray producing components of a tube are contained within a tube housing, formed of stainless steel or other metal. Much of the excess heat is directed to the inner surface of the tube housing by means of thermal radiation. That is, a hot surface within the tube vacuum, such as the hot anode surface, will dissipate power to a cooler surface within the same vacuum space (e.g., the inner surface of the vacuum housing) by the emission of electromagnetic radiation. Since the radiation strikes the inner surface of the vacuum housing, it is very desirable to enhance the absorption of radiation at that location and minimize the amount of heat reflected back to the rotary anode and other internal tube components. The heat transferred to the housing may then be readily removed from the X-ray tube by means of a cooling fluid (usually, but not limited to, a dielectric mineral oil) which is circulated around the outer surface of the tube housing. Typically, the heat is carried by the cooling oil to a heat exchanger and dissipated thereby.

Generally, the efficiency of the thermal radiation transfer process can be engineered and exploited by adjusting the emissivity of X-ray tube component surfaces, such as the anode and housing inner surfaces, which are emitters and absorbers respectively, of thermal radiation. Herein, "emissivity" is defined as a measure of the efficiency of NIR absorption relative to the theoretically ideal "black body" absorber. The emissivity will be expressed as a fraction of the theoretical ideal. For example, at a given wavelength, a surface with an emissivity of 0.5 will absorb 50% of the radiant power that a theoretically ideal black body is capable of absorbing. Accordingly, increasing the inner surface emissivity of the vacuum housing reduces the fraction of radiation power reflected thereby back toward the hot anode.

In metals, surface techniques that roughen the surface tend to improve the emissivity of the surface, especially in the critical NIR region of the electromagnetic spectrum of a hot rotating anode X-ray tube. In the past, methods such as grit-blasting, acid etching and plasma etching have been routinely used to increase surface emissivity. High emissivity coatings consisting of oxides, nitrides or carbides, have also been used and have been deposited by a number of methods, including plasma spray, chemical vapor deposition and physical vapor deposition. The type of process utilized and the materials selected are dictated by the application, the temperature range of interest and the environment to which the coating is exposed. However, prior art oxide coatings generally comprise nickel or iron oxides. It is very common for these oxides to reduce or evaporate when subjected to intense heat, that is, to give up oxygen and go back to base metal. Moreover, it has been found that coatings applied by plasma spray techniques tend to flake or crack off. It has also been found that efforts to increase emissivity by roughening a surface, such as by grit-blasting or acid etching, may leave an undesirable residue or may have non-uniform results over a surface.

SUMMARY OF THE INVENTION

The invention is directed to a comparatively simple technique for enhancing thermal radiation heat transfer between components within an X-ray vacuum tube, that is, from a hot component such as the rotating anode assembly to a cooler component such as the metal tube housing. These results are achieved by increasing the surface emissivity of the components, and more particularly by forming a chromium oxide coating thereon. By selective oxidation of the chromium alloying agent in a high chromium content alloy, in accordance with the inventive method described herein, it is possible to form refractive, oxide coatings that exhibit high absorption in the NIR region of the electromagnetic spectrum. This coating is tenaciously bonded to the base metal and does not evaporate or reduce at very high temperatures, such as 1000° C., in vacuum. By oxidizing the surface of the vacuum housing, target cooling is enhanced significantly, as a greater fraction of the NIR power radiated thereto is absorbed rather than reflected back to the hot target. The vacuum housing temperature increases as it absorbs NIR, and is subsequently cooled by the lower temperature dielectric oil flowing over its external surface.

The invention is usefully embodied as a method for providing a selected X-ray tube component which has a desired thermal radiation transfer characteristic. The method comprises the steps of fabricating the component from an alloy containing a specified minimum amount of chromium, and then implementing a first heating operation which comprises heating the fabricated component in a dry hydrogen atmosphere, for a first specified time period, at a temperature selected from the range 1100°–1150° C. Thereafter, a second heating operation is implemented, wherein the fabricated component is heated in a wet hydrogen atmosphere for a second specified time period at a temperature selected from the same range. Preferably, the method also includes the step of purging the fabricated component with a selected inert gas or nitrogen, between the first and second heating operations. This invention will solution anneal and transform alloys that respond to heat treating and age hardening (examples include martensitic stainless steels and superalloys). Subsequent thermal processing after coating may be necessary for alloys that fall under these categories. For example, precipitation aging of a superalloy could be accommodated in the same furnace during the cool-down step immediately after the wet hydrogen fire.

In a preferred embodiment, the component is fabricated from an alloy which is at least 12% chromium by weight. Higher chromium content alloys will yield higher emissivity values and form coatings that have greater thermal stability. Alloys that have chromium contents >18% (i.e. 300 series stainless steels) are considered the ideal embodiment of this invention. The dry hydrogen atmosphere of the first heating operation has a dew point which is less than −5° C., and the wet hydrogen atmosphere of the second heating operation has a dew point which is on the order of 18° C. or greater. Preferably also, the fabricated component is selectively cooled between the first and second heating operations. Usefully, components selected for the method include all of the subassemblies that constitute the X-ray tube vacuum housing.

In another embodiment, the invention comprises a product formed by the method described above.

DETAILED DESCRIPTION OF THE PREFERRED EMBODIMENT

Figure 1:
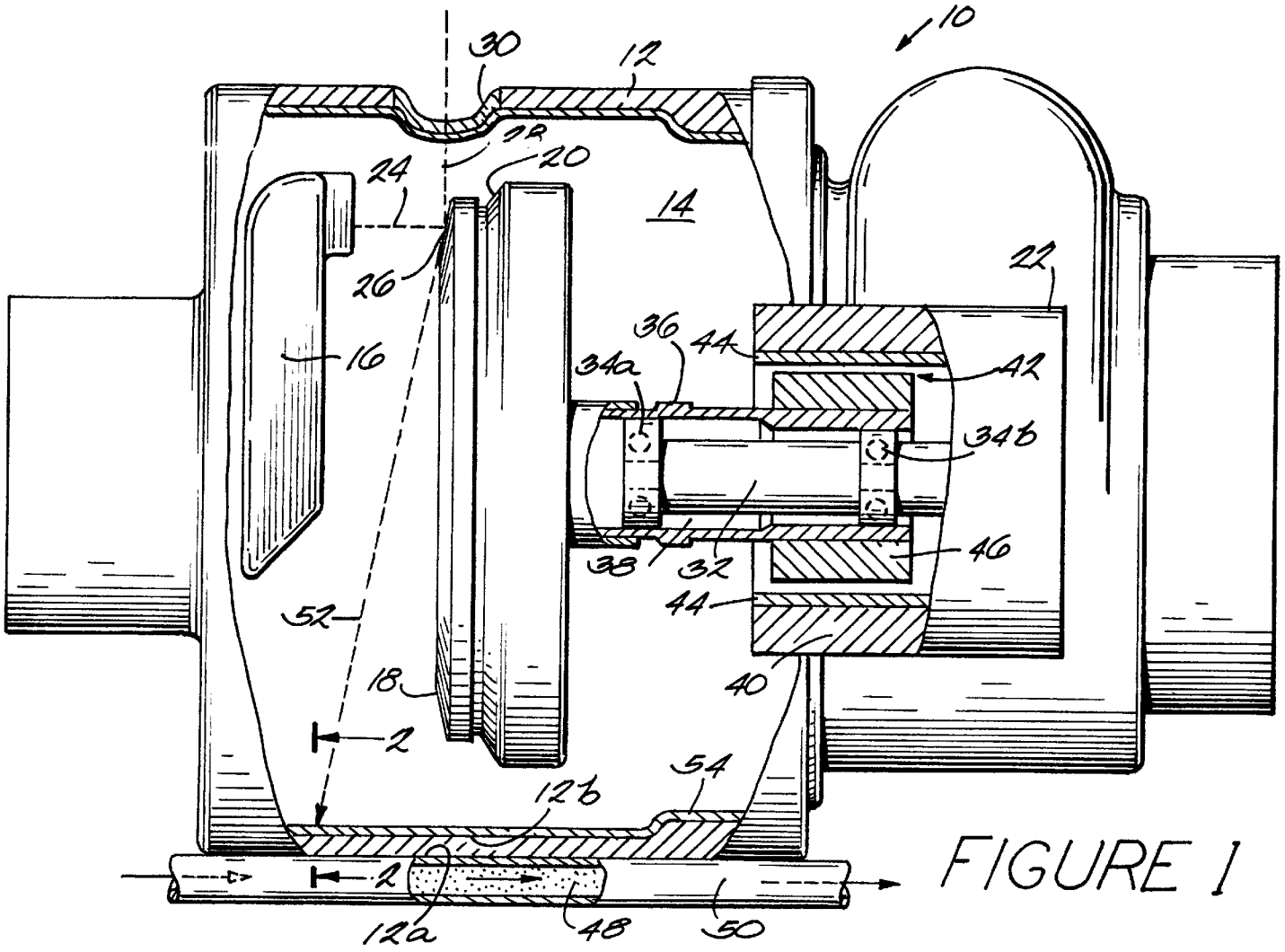
FIG. 1 is a perspective view with a section broken away, showing an X-ray tube provided with an embodiment of the invention.

Referring to FIG. 1, there is shown an X-ray tube 10. In accordance with conventional practice, tube 10 generally includes a metal housing 12, which supports other X-ray tube components of tube 10 including a cathode 16, and also provides a protective vacuum enclosure 14 therefor. Housing 12 comprises an alloy such as stainless steel which, for reasons set forth hereinafter, has a high chromium content. More particularly, to achieve maximum emissivity values and the highest resistance to thermal degradation, the chromium content of housing 12 must be >18% by weight. Cathode 16 directs a high energy stream of electrons 24 onto a target track 18 of an anode 20, which consists of a disk composed of a low expansivity refractory metal, for example, a molybdenum based alloy. Anode 20 is continually rotated by means of an anode mounting and drive mechanism 22, described hereinafter. Target track 18 has an annular or ring-shaped configuration and typically comprises a tungsten based alloy integrally bonded to the molybdenum based anode disk 20. As anode 20 rotates, the stream of electrons from cathode 16 impinges upon a continually changing portion of track 18 to generate X-rays. Electrons strike the target 18 at a focal spot which generally remains at a position 26 as the anode target rotates. A beam of X-rays 28 is thereby generated, which is projected from the anode focal spot through an X-ray transmissive window 30, provided in the side of housing 12.

FIG. 1 further shows anode mounting and drive mechanism 22 provided with a bearing support member 32 carrying a front set of rotary bearings 34*a* and a rear set of rotary bearings 34*b*. Anode 20 is provided with a shaft 36 having a recess 38 sized to receive member 32 and bearings 34*a* and 34*b*, so that anode shaft 36 and anode 20 are rotatably supported thereby. To rotatably drive the anode, stator windings 40 of an induction motor 42 are mounted on a frame 44, supported by the housing 12, and the rotor 46 of the motor is mounted on anode shaft 36. Thus, when electrical power is applied to the stator windings 40 through a suitable power transmission path (not shown), motor 42 operates, in conventional manner, to rotatably drive rotor 46 and thereby anode shaft 36 and anode 20.

As stated above, a substantial amount of heat is generated during the production of X-rays. This non-productive energy must be substantially removed from the anode 20 and regions proximate thereto. Otherwise, this energy over time may damage components supporting the anode, particularly the front bearings 34*a*. Accordingly, FIG. 1 further shows cooling fluid 48, typically comprising a dielectric oil, passed across the outer surface 12*a* of housing 12 during operation of tube 10. Cooling oil 48 is directed through a conduit 50 or the like, which is in close, abutting relationship with outer surface 12*a*. It is to be understood that a number of other conduits are positioned around the circumference of outer surface 12*a*. The oil that passes through respective conduits 50 is pumped through a heat exchanger, which cools the oil and returns it back to the tube.

In order for heat to reach cooling oil 48, it must first be transferred from the anode 20, or other hot components within enclosure 14, to the housing 12. Referring further to FIG. 1, there is shown a thermal radiation component 52, comprising radiation in the NIR region defined above, which is directed from target track 18 of anode 20 to the inner surface 12*b* of housing 12. It is very desirable to absorb as much of this heat as possible into the housing 12, so that it can pass therethrough to cooling oil 48 by thermal conduction. The amount of NIR thermal energy which is reflected back into enclosure 14 is thereby minimized. In accordance with the invention, it has been recognized that absorption of NIR energy can be significantly improved by forming a native oxide coating 54, composed mainly of chromium oxide, on the inner surface 12*b* of housing 12. This substantially enhances the cooling of hot, internal tube components that radiate NIR energy to the housing. The temperature of vacuum housing 12 increases as it absorbs NIR energy from the hot components, and the housing is subsequently cooled by the lower temperature dielectric oil 48 flowing over the external surfaces 12*a*. Moreover, anode and other hot internal tube components can be coated as described herein, to enhance emission of NIR power therefrom to the housing 12.

Figures 2, 3:
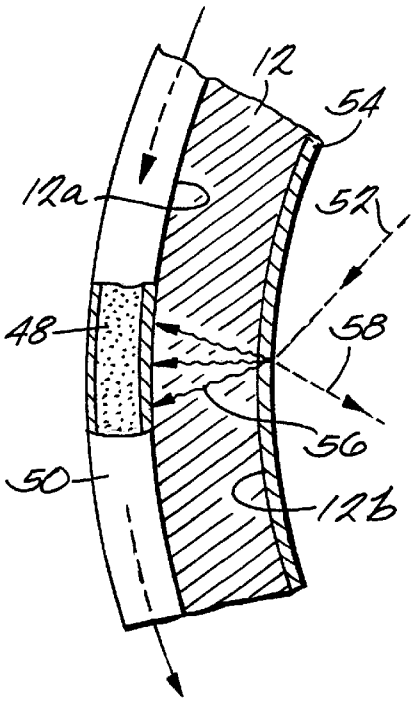
FIG. 2 is a sectional view taken along lines 2—2 of FIG. 1, showing the tube housing provided with a coating formed in accordance with an embodiment of the invention.
FIG. 3 is a table showing emissivity measurements of sample components provided with the coating described herein, as a function of wet hydrogen atmosphere dew point and over a specific range of wavelengths in the NIR spectrum.

Referring to FIG. 2, there is shown thermal energy components 56, comprising a substantial portion of the thermal energy of radiation component 52, being absorbed into housing 12 due to the high level of emissivity provided by coating 54 formed on inner surface 12*b*. Thermal energy components 56 flow through housing 12 to cooling oil 48, and are removed thereby to cool the X-ray tube 10. FIG. 2 further shows thermal energy component 58, comprising a lesser portion of the energy of radiation component 52, which is reflected back into enclosure 14.

A chromium oxide coating procedure, comprising an illustrative embodiment of the invention, is usefully implemented in connection with an X-ray tube housing 12 which is formed of 304 series stainless steel, and which contains 18%–20% chromium by weight. This requirement is very convenient, since many components fabricated for X-ray tube devices are commonly manufactured from alloys that possess considerable weight fractions of the alloying agent chromium. These alloys include 300 and 400 series stainless steels, nickel-chromium alloys and superalloys including iron, nickel and cobalt-based types. However, in the past these alloys have included chromium primarily to impart corrosion resistance, especially where high service temperatures and oxidizing atmospheres are encountered.

It is anticipated that the procedure of the invention will work on any alloy system that contains a sufficient quantity of chromium, that is, which is at least 12% chromium by weight. The procedure requires a furnace capable of operating at temperatures of 1100° C., in both dry hydrogen and wet hydrogen gas atmospheres. The procedure also requires the ability to measure the dew point (d.p.) of the wet hydrogen gas atmosphere, for reasons set forth hereinafter. As is well known, dew point is the temperature at which water vapor, purposely entrained in the hydrogen gas flow, condenses.

In accordance with the coating procedure, the housing 12 (or other component to be coated) is initially fabricated to the shape and design specifications required therefor. In this example, the housing 12 is fabricated from 4 mm thick sheet and the hold times are appropriate for this material form; the time being a function of the thickness, total mass of the component and furnace power available. The fabricated component is then cleaned, prior to further processing, to ensure that it is free of surface contaminants. Thereupon, a first heating operation is implemented, wherein the part or component is placed in the furnace and an 1100° C., 60 minute furnace fire is applied thereto, in a dry hydrogen gas atmosphere. That is, the atmosphere contains hydrogen gas and has a dew point of less than −5° C. The first heating operation is followed by a second heating operation, wherein the component is placed in the furnace and an 1100° C., ninety minute furnace fire is applied thereto, in a wet hydrogen atmosphere. The wet hydrogen atmosphere has a high water content and a dew point on the order of 18° C.

It is generally necessary to cool down the component between the dry and wet furnace operations. However, it is critical that the component remain in the furnace during the cool down period, and be purged with either an inert gas or nitrogen. Failure to do this will result in the formation of oxides on the component surfaces that do not have certain characteristics required for the chromium oxide coating, i.e., high emissivity and high temperature stability.

The heating operations described above draw chromium to the surface of the component, to form a chromium oxide coating thereon. This procedure will normally produce a uniform, dark green to gray chromium oxide coating, over the entire surface, which exhibits a surface emissivity of about 0.90 at a wavelength of 2 microns NIR-Higher dew points, i.e., dew points in excess of 18° C., and furnace firing times in excess of 90 minutes will produce thicker oxide coatings. Thus, surface emissivity is a function of the dew point value, particularly at low dew point values, whereby the ability to measure dew point is required for the coating procedure. The rate of chromium oxide formation is governed by the diffusion of chromium through the forming oxide layer. Hence, higher temperatures during the wet hydrogen step will increase the rate of chromium oxide formation by increasing the rate of chromium self-diffusion through the coating. However, temperatures greater than 1100° C. may result in deleterious deformation of components due to creep effects.

Referring to FIG. 3, there is shown a table illustrating emissivity as a function of dew point of the wet hydrogen atmosphere, i.e., during the second heating operation. More particularly, the table of FIG. 3 sets forth emissivity measurements obtained from several tests, set forth in the table as Tests 1, 2 and 3, respectively. Each test was directed to three component samples, referred to respectively as Samples 1, 2, and 3. Each sample was coated in accordance with the procedure described above, with the dew point of the wet hydrogen atmosphere being different for each coating procedure. Thus, the three samples used for Test 1 were coated at a dew point of 25.2° C., the three samples of Test 2 were coated at a dew point of 18° C., and the three samples of Test 3 were coated at a dew point of 5.8° C. Emissivity of the resulting coatings was measured for the samples prepared for each dew point, at varying levels of NIR. The table of FIG. 3 clearly shows that emissivity is increased by processing components at higher dew point levels.

Figure 4:
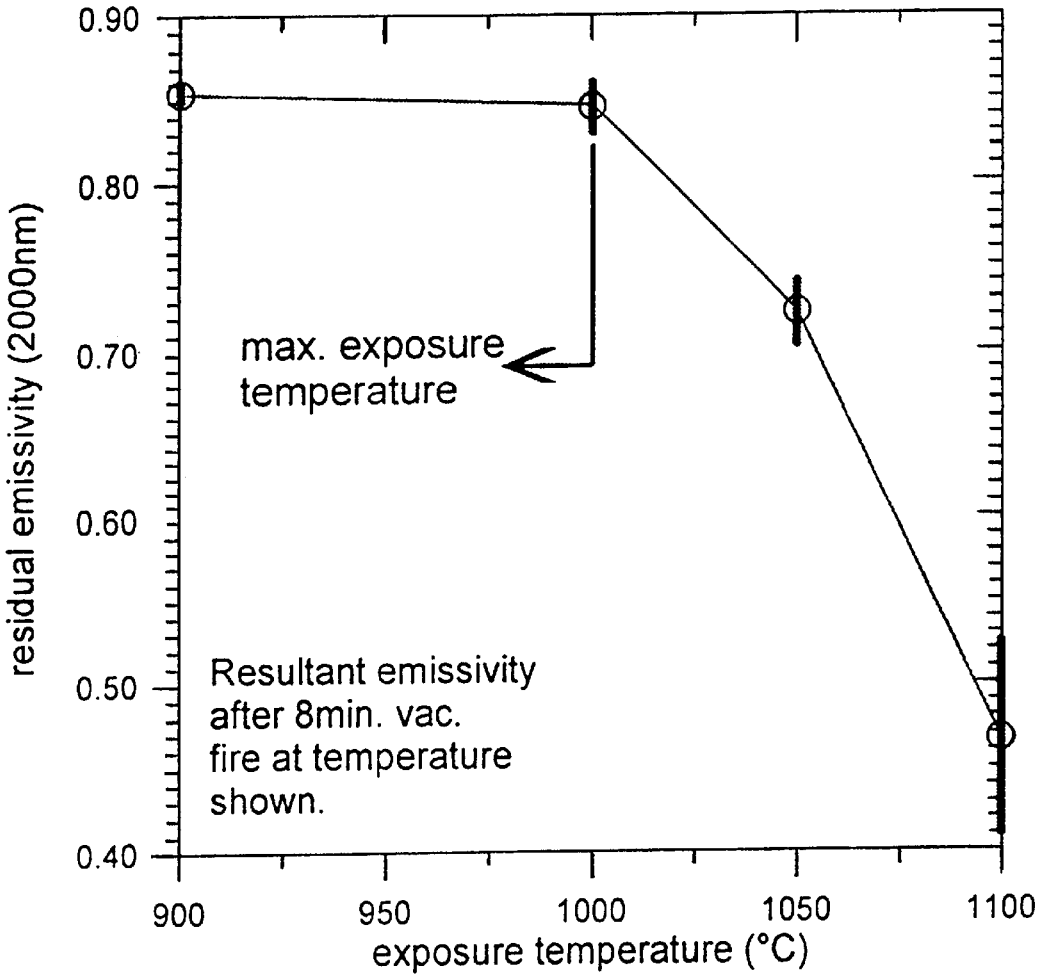
FIG. 4 is a graph depicting effects of very high temperatures on the emissivity of a component coated in accordance with an embodiment of the invention.

The chromium oxide coating formed by the process described herein must be stable at elevated temperatures, especially in a vacuum environment. This is particularly important for parts or components that are subjected to further high temperature processing after the coating has been formed thereon, in the course of putting components together to form the X-ray tube. For example, coated components could be subjected to brazing or furnace firing operations, wherein reduction and/or evaporation of the chromium oxide coating would significantly reduce the effective NIR absorbtivity of the component surface. Accordingly, to determine the possible loss of emissivity when coated components are exposed to high temperature thermal cycles, e.g., furnace brazing cycles, precipitation aging or tempering, a sample of 1 mm thick 304 stainless steel was provided with the chromium oxide coating as described herein. The sample was then furnace fired in a vacuum over a range of temperatures typically employed in brazing. FIG. 4 shows the emissivity of the sample, measured after such furnace firing (i.e. residual emissivity) and indicates that the emissivity of the sample does not decrease until the firing temperature exceeds 1000° C. for an eight minute exposure in vacuum. Thus, the maximum exposure temperature is found to be at or near 1000° C. It has been discovered that the maximum exposure temperature limit is directly related to the temperature of the wet hydrogen heating operation, described above, and will increase or decrease proportionately as the wet hydrogen operation temperature is increased or decreased, from the 1100° C. value disclosed above.

While it has been found that 1100° C. is a preferred furnace firing temperature for both the first and second heating operations, it is anticipated that other embodiments of the invention could use other temperatures therefor. Generally, it is anticipated that any temperature selected from the range 1100°–1250° C. could be used for the first heating operation, and any temperature selected from the same range could be used for the second heating operation.

Obviously, many other modifications and variations of the present invention are possible in light of the above teachings. It is therefore to be understood that within the scope of the disclosed concept, the invention may be practiced otherwise than as has been specifically described.

What is claimed is:

1. A method for providing a selected X-ray tube component with a specified thermal radiation transfer characteristic, said method comprising the steps of:

fabricating said component from an alloy containing a specified minimum amount of chromium;

implementing a first heating operation comprising heating said fabricated component in a dry hydrogen atmosphere for a first specified time period, at a temperature selected from the range 1100° C.–1150° C.; and implementing a second heating operation comprising heating said fabricated component in a wet hydrogen atmosphere for a second specified time period, at a temperature selected from the range 1100° C.–1150° C. to form a chromium oxide coating of selected thickness on at least one surface of said component.

2. The method of claim 1 wherein:

said method includes the step of purging said fabricated component with a selected inert gas between said first and second heating operations.

3. The method of claim 2 wherein:

said component is fabricated from an alloy which is at least 12% chromium by weight.

4. The method of claim 3 wherein:

the dry hydrogen atmosphere of said first heating operation has a dew point which is less than 5° C., and the wet hydrogen atmosphere of said second heating operation has a dew point which is on the order of 18° C. or higher.

5. The method of claim 3 wherein:

said component is selectively cooled between said first and second heating operations.

6. The method of claim 3 wherein:

said purging is in either inert gas or Nitrogen.

7. The method of claim 3 wherein:

said component comprises an X-ray tube housing having an inner surface disposed to receive substantial thermal radiation in the NIR frequency range during the production of X-rays by said tube.

8. The method of claim 3 wherein:

said component comprises a rotary anode for an X-ray tube which is disposed to emit substantial thermal radiation in the NIR frequency range during the production of X-rays by said tube.

9. The method of claim 3 wherein:

said component is formed of stainless steel containing in excess of 18% chromium by weight.

10. The method of claim 3 wherein:

said method includes the step of cleaning said fabricated component, prior to said first heating operation, to remove surface contaminants therefrom.

11. The method of claim 3 wherein:

said first specified time period for said first heating operation is 60 minutes, and said second specified time period for said second heating operation is 90 minutes.

12. The method of claim 3 wherein:

said chromium oxide coating formed on said component provides said component with a surface emissivity on the order of 0.90 at a wavelength of 2 microns NIR.

13. The method of claim 3 wherein:

said second heating operation has a dew point value selected to provide a specified surface emissivity having a functional relationship to said dew point value.

14. A selected component for a vacuum X-ray tube, said component being constructed by a process comprising the steps of:

initially fabricating said component in conformance with a given set of specifications, and from an alloy which is at least 12% chromium by weight;

performing a first heating operation on said fabricated component, wherein said fabricated component is heated in a dry hydrogen atmosphere for a first specified time period, at a temperature selected from the range 1100° C.–1150° C.; and performing a second heating operation on said fabricated component, wherein said fabricated component is heated in a wet hydrogen atmosphere for a second specified time period, at a temperature selected from said range, to form a chromium oxide coating on at least one surface of said component, and to thereby provide said component with a specified value of surface emissivity.

15. The component of claim 14 wherein:

said fabricated component is purged with a selected inert gas or nitrogen between said first and second heating operations.

16. The component of claim 15 wherein:

the dry hydrogen atmosphere of said first heating operation has a dew point which is less than 5° C., and the wet hydrogen atmosphere of said second heating operation has a dew point which is on the order of 18° C. or higher.

17. The component of claim 16 wherein:

said component is fabricated from stainless steel containing in excess of 18% chromium by weight.

18. The component of claim 17 wherein:

said chromium oxide coating formed on said component provides said component with a surface emissivity on the order of 0.90 at a wavelength of 2 microns NIR.

19. The component of claim 18 wherein:

said component comprises an X-ray tube housing having an inner surface disposed to receive substantial thermal radiation in the NIR frequency range during the production of X-rays by said tube.

20. The method of claim 18 wherein:

said component comprises a rotary anode for an X-ray tube which is disposed to emit substantial thermal radiation in the NIR frequency range during the production of X-rays by said tube.

* * * * *